US006264502B1

(12) United States Patent
Pan

(10) Patent No.: US 6,264,502 B1
(45) Date of Patent: Jul. 24, 2001

(54) CONNECTOR ASSEMBLY FOR DECORATIVE LIGHTING NET

(76) Inventor: Wun Fang Pan, No. 123, Lane 99, Pu Din Road, Hsinchu (TW)

( * ) Notice: Subject to any disclaimer, the term of this patent is extended or adjusted under 35 U.S.C. 154(b) by 0 days.

(21) Appl. No.: 09/477,481

(22) Filed: Jan. 6, 2000

(51) Int. Cl.[7] ..... H01R 13/66; H01R 13/60

(52) U.S. Cl. ..... 439/575; 439/574

(58) Field of Search ..... 439/574, 575; 362/391, 396, 401, 226, 252

(56) References Cited

U.S. PATENT DOCUMENTS 6,082,874 * 7/2000 Huang ..... 362/226

* cited by examiner

*Primary Examiner*—Brian Sircus
*Assistant Examiner*—Chandrika Prasad
(74) *Attorney, Agent, or Firm*—Rosenberg, Klein & Lee

(57) ABSTRACT

A connection assembly for a decorative lighting net employing intercrossed electrical wires to connect a plurality of bulb units (for complete net or curtain-type decorative effect, for instance) is provided. The connection assembly includes a bulb holder having an arched hook formed at a side thereof. The connection assembly also includes a bulb connector coupled to the bulb holder having a stick formed at a side thereof. The stick blocks wires retained within the arched hook from escape.

1 Claim, 5 Drawing Sheets

CONNECTOR ASSEMBLY FOR DECORATIVE LIGHTING NET

BACKGROUND OF THE INVENTION

Conventional decorative lighting net, used popularly in this time, is comprised of several lighting strings with an electrical wire and a plurality of miniature bulb units, wherein the wires are intercrossed and connected with bulb holders. A connecting structure is provided to connect the electrical wire and the bulb unit together to become a net. The known connecting structure is simply an elastic hook mounted on the bulb holder to hook the wire. It can not provide enough connecting strength. The wire will be released from the hook of the bulb holder without difficulty when a sideward force occurs. So the net structure will be destroyed and the decorative effect is thus lost.

In view of the problem, it is a primary object of the invention to provide a connecting structure of a decorative lighting net, which includes an arched hook formed on a side of a bulb holder and a stick formed on a bulb connector for effecting better connecting strength and overcome the drawbacks of the prior art.

Now the features and advantages of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
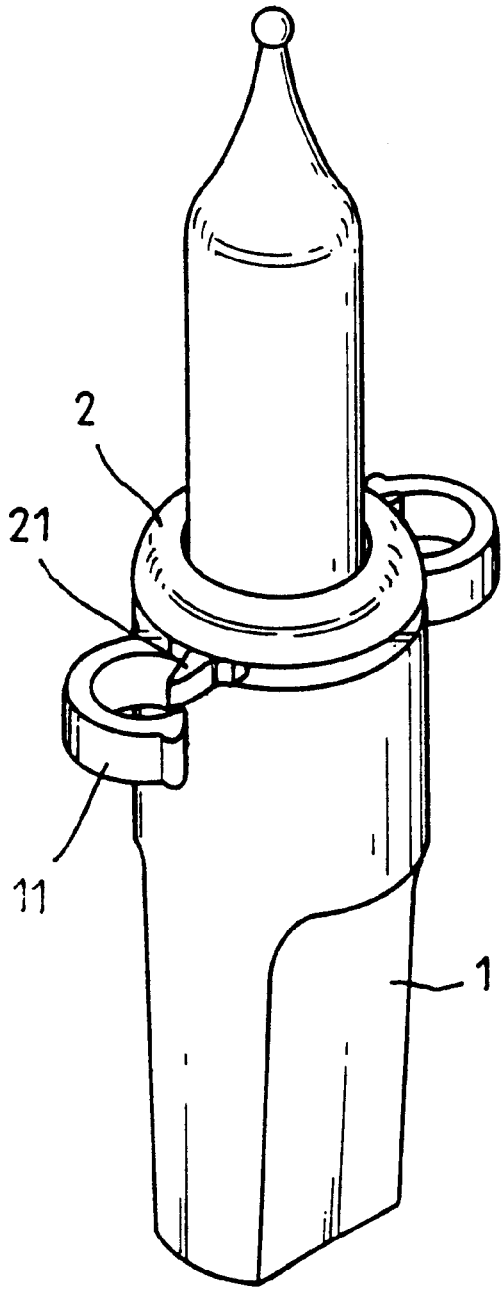
FIG. 1 is a perspective view illustrating the connecting structure of a bulb unit according to the invention.
Figure 2:
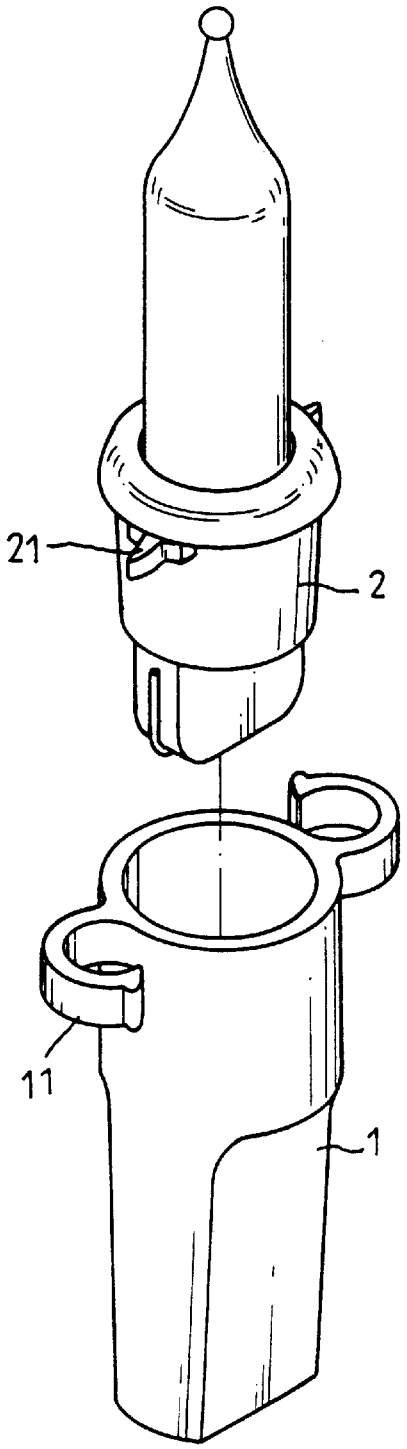
FIG. 2 is an exploded perspective view of FIG. 1.

Referring to FIGS. 1 and 2, the present invention is to provide an improvement on a connecting structure of a decorative lighting net. It can be seen that both sides of the bulb holder (1) are provided with a respective arched hook (11). Both sides of the bulb connector (2) are provided with a respective stick (21). When the connector (2) is received in the bulb holder (1), the stick (21) is just placed at an opening segment from free end of the arched hook (11) to the fringe of the bulb holder (1).

Figure 4:
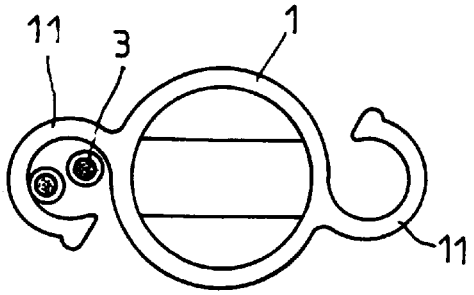
FIG. 4 is a top plan view of FIG. 3.
Figure 6:
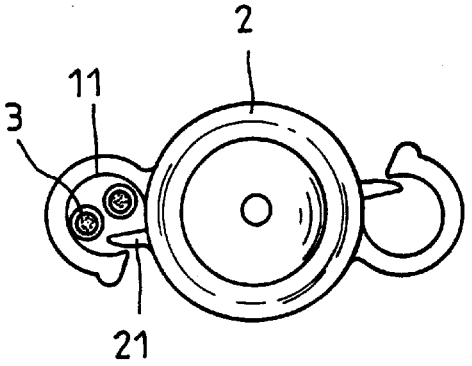
FIG. 6 is a top plan view of FIG. 5.
Figure 3:
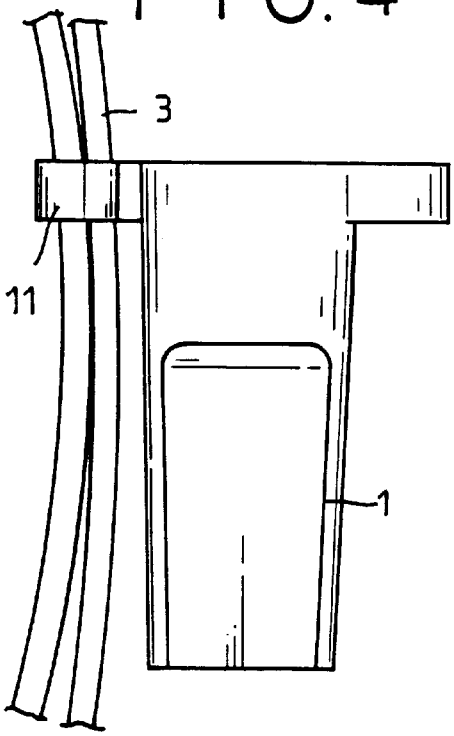
FIG. 3 is a plan view illustrating the bulb holder of the bulb unit with electrical wires according to the invention.
Figure 5:
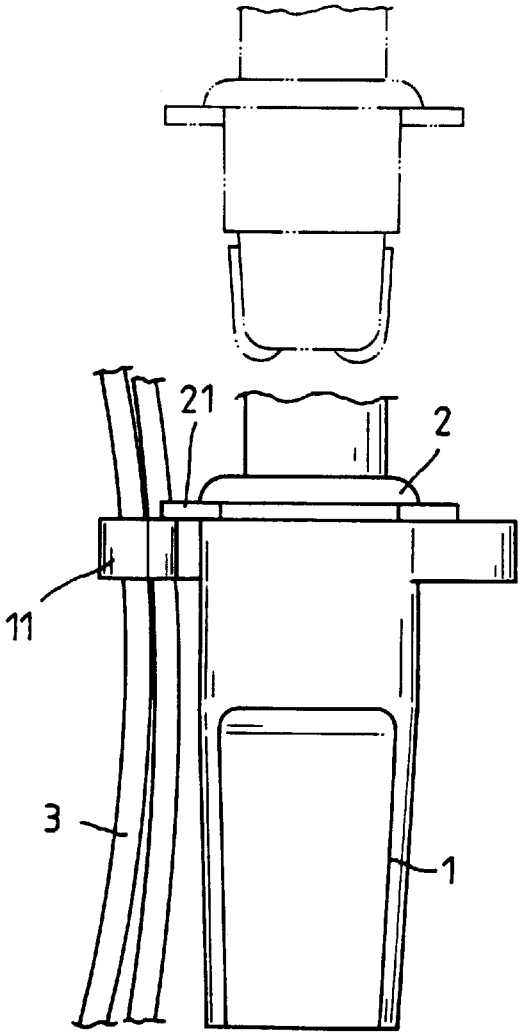
FIG. 5 is a plan view of FIG. 3 connecting with a bulb connector.
Figure 7:
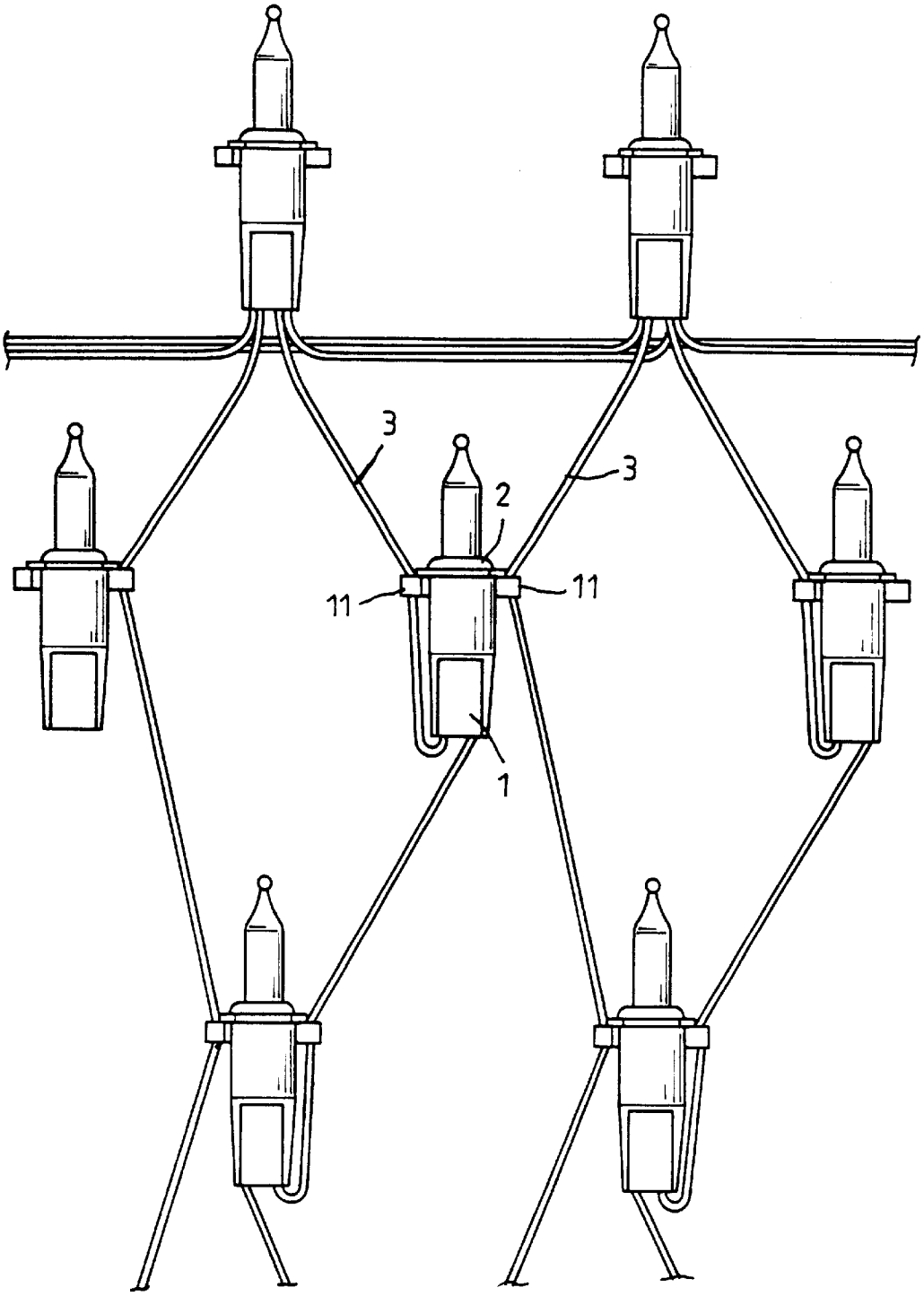
FIG. 7 is a plan view depicting a decorative lighting net according to the present invention.

In use, the electrical wire (3) is forced in the arched hook (11), as shown in FIGS. 3 and 4, and then the bulb connector (2) is received in the bulb holder (1), as shown in FIGS. 5 and 6. After this connection, the electrical wire (3) will be obstructed by the stick (21) and can never be separated from the hook (11). It can be understood that the connection of the electrical wires will be strong enough to connect the wires and the bulb units to become a decorative lighting net, as shown in FIG. 7, to show a perfect lighting effect.

Figure 8:
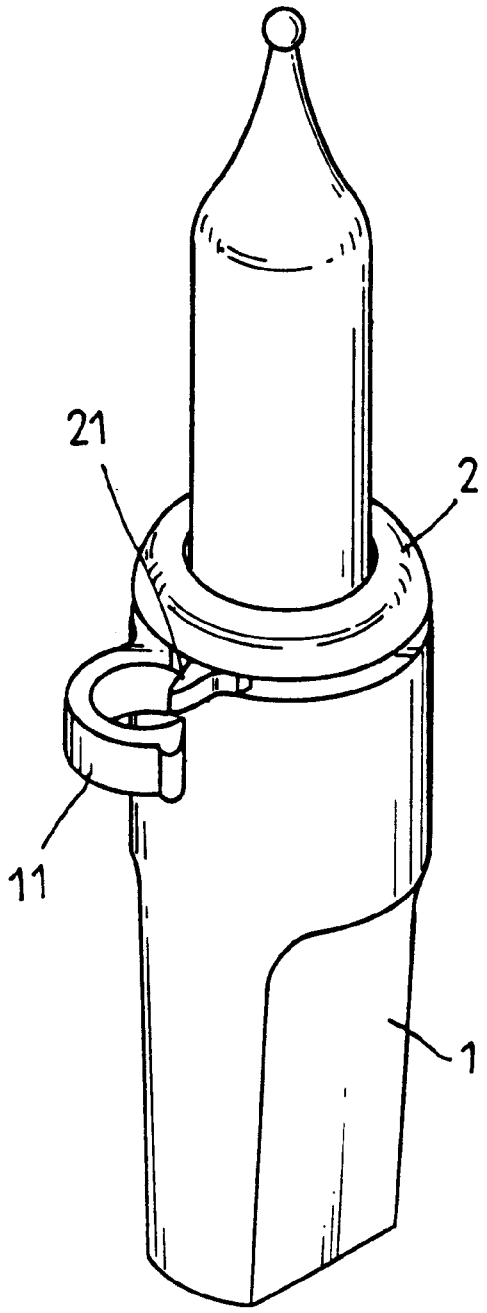
FIG. 8 is a perspective view illustrating another embodiment of the connecting structure of a bulb unit according to the invention.

The arched hook accompanying with the stick can obviously provide an effective force for connecting with the wires to assemble a decorative net. In FIG. 8, it depicts only a connecting structure is provided for use as a curtain-type decorative lighting string. This embodiment can also obtain a same purpose for utility.

In summary, the present invention provides a decorative lighting net with an invented structure and providing a better utility. It has superiority over prior art net structures obviously and should be allowed for patent.

What is claimed is:

1. A connection assembly for connecting a bulb unit to at least one electrical wire of a decorative lighting net comprising:

(a) a bulb holder having a longitudinally extended base portion and at least one arched hook portion extending laterally therefrom for retaining the electrical wire, said arched hook portion including a free end spaced from said base portion to describe a looped configuration having a lateral opening; and, (b) a bulb connector for retaining the bulb unit, said bulb connector including a main portion received in said base portion of said bulb holder and at least one stick portion extending laterally therefrom, said stick portion being longitudinally offset from said arched hook portion of said bulb holder, and being laterally extended substantially over said lateral opening of said arched hook portion for blocking the escape of electrical wire from said arched hook portion without engaging said free end of said arched hook.

* * * * *